US008387392B2

(12) United States Patent
Kim et al.

(10) Patent No.: US 8,387,392 B2
(45) Date of Patent: Mar. 5, 2013

(54) FUEL INJECTION SYSTEM AND BURNER USING THE SAME

(75) Inventors: Se Won Kim, Yongin-si (KR); Myung Chul Shin, Cheonan-si (KR); Chang Yeop Lee, Seoul (KR)

(73) Assignee: Korea Institute of Industrial Technology, Cheonan-si, Chungcheongnam-do (KR)

( * ) Notice: Subject to any disclaimer, the term of this patent is extended or adjusted under 35 U.S.C. 154(b) by 1111 days.

(21) Appl. No.: 12/338,356

(22) Filed: Dec. 18, 2008

(65) Prior Publication Data

US 2010/0126175 A1 May 27, 2010

(30) Foreign Application Priority Data

Nov. 21, 2008 (KR) ..... 10-2008-0116012

(51) Int. Cl.
*F02C 1/00* (2006.01)
*F02C 7/08* (2006.01)
*F02G 3/00* (2006.01)

(52) U.S. Cl. ..... 60/742; 60/746; 60/736; 60/748

(58) Field of Classification Search ..... 60/742, 60/746, 736, 748; 431/8, 9, 10
See application file for complete search history.

(56) References Cited

U.S. PATENT DOCUMENTS

| | | | | |
|---|---|---|---|---|
| 1,546,038 | A * | 7/1925 | Smith | 431/11 |
| 4,262,482 | A * | 4/1981 | Roffe et al. | 60/736 |
| 4,575,332 | A * | 3/1986 | Oppenberg et al. | 431/9 |
| 4,708,638 | A * | 11/1987 | Brazier et al. | 431/116 |
| 4,763,481 | A * | 8/1988 | Cannon | 60/737 |
| 4,815,966 | A * | 3/1989 | Janssen | 431/174 |
| 5,253,478 | A * | 10/1993 | Thibault et al. | 60/733 |
| 5,441,403 | A | 8/1995 | Tanaka et al. | |
| 5,657,632 | A * | 8/1997 | Foss | 60/742 |
| 5,836,164 | A * | 11/1998 | Tsukahara et al. | 60/733 |
| 6,007,325 | A | 12/1999 | Loftus et al. | |
| 6,389,815 | B1 * | 5/2002 | Hura et al. | 60/746 |
| 6,453,660 | B1 * | 9/2002 | Johnson et al. | 60/39.821 |
| 7,367,798 | B2 * | 5/2008 | Sarv | 431/185 |
| 2007/0137207 | A1 * | 6/2007 | Mancini et al. | 60/737 |
| 2007/0202449 | A1 | 8/2007 | Godon | |

FOREIGN PATENT DOCUMENTS

| | | |
|---|---|---|
| GB | 2 146 113 A | 4/1985 |
| JP | 2000-213713 A | 8/2000 |
| NL | 37909 C | 4/1936 |

OTHER PUBLICATIONS

European Search Report; Korean Institute of Industrial Technology; Application No. 08874074.1—1266 / 2220435 PCT/KR2008007383; Sep. 23, 2011.

* cited by examiner

*Primary Examiner* — William H Rodriguez
*Assistant Examiner* — Carlos A Rivera
(74) *Attorney, Agent, or Firm* — Arent Fox LLP

(57) ABSTRACT

Disclosed herein is a fuel injection system, including: a fuel injection module including a primary fuel injector and one or more secondary fuel injectors disposed around the primary fuel injector; an air supply module for supplying air to the fuel injection module inwardly and outwardly; and a fuel supply module for supplying fuel to the fuel injection module, wherein the fuel injection module serves to generate multi-stage flames in a burner by forming a rich fuel flame region using the primary fuel injector and forming a lean fuel flame region behind the rich fuel flame region using the secondary fuel injectors through a burning process of gasifying secondary fuel.

11 Claims, 8 Drawing Sheets

Formation Volume of Nitrogen Oxides (Diesel Oil Fuel)

Q: Burner according to conventional prior art
P: Burner according to the present invention

FUEL INJECTION SYSTEM AND BURNER USING THE SAME

BACKGROUND OF THE INVENTION

1. Field of the Invention

The present invention relates to a liquid fuel injection system, and, more particularly, to a liquid fuel injection system comprising a double-structured fuel nozzle including a primary flame region located in the center of the fuel nozzle and a partial oxidation region formed by the partial oxidation of liquid fuel.

2. Description of the Related Art

Generally, methods of reducing nitrogen oxides (NOx) generated by burning fossil fuels may include a method of preventing the formation of nitrogen oxides by physically, chemically and biochemically by removing nitrogen components from fuel before the burning of fuel, a method of controlling the formation of nitrogen oxides during the burning of fuel, and a method of removing nitrogen oxides from exhaust gas after the burning of fuel.

Among the methods of reducing nitrogen oxides (NOx), since the method of controlling the formation of nitrogen oxides during the burning of fuel, in which a low NOx burner and multistage burning and reburning techniques are used, can relatively easily prevent the formation of nitrogen oxides (NOx) and can be applied to both the existing facilities and new facilities at low fixed investment costs and low operation costs, it is very economical, and is thus intensively researched and developed by advanced enterprises.

In a system for burning liquid and solid fuels, a burning technology for realizing low NOx is most important to control the formation of fuel NOx caused by the oxidation of nitrogen in fuel.

In the low NOx technology, the formation of fuel NOx is controlled by decreasing the conversion ratio of nitrogen (N) into nitrogen oxides (NOx) in fuel, and residence time taken to reduce NOx to $N^2$ is controlled by clearly dividing a burning area into a rich fuel region and a lean fuel region and forming a fuel-air mixed area using rotating flow, thereby realizing ultralow NOx.

In most conventional liquid fuel burners, thermal NOx is reduced by decreasing a flame temperature using steam or latent heat of evaporation attributable to water injection, but the formation of fuel NOx in flame due to the nitrogen components in fuel is very remarkable, therefore these liquid fuel burners cannot completely reduce NOx. Further, in conventional multistage burners, since it is difficult to physically clearly divide a flame area into a rich fuel flame region and a lean fuel flame region, it is impossible to prevent the formation of a local high-temperature region in flame, and thus a relatively large amount of thermal NOx is generated. Currently, since the design technologies of new concept fuel nozzles and burners are insufficient, there is a problem that alternative technologies for remarkably reducing fuel Nox are not basically established.

SUMMARY OF THE INVENTION

Accordingly, the present invention has been made keeping in mind the above problems occurring in the prior art, and an object of the present invention is to provide a fuel injection system, which can basically prevent the formation of fuel nitrogen oxides (fuel NOx), caused by the oxidation of nitrogen components included in fuel supplied to a burning furnace, and thermal nitrogen oxides (thermal NOx), and a burner using the same.

In order to accomplish the above object, an aspect of the present invention provides a fuel injection system, including: a fuel injection module including a primary fuel injector and one or more secondary fuel injectors disposed around the primary fuel injector; an air supply module for supplying air to the fuel injection module inwardly and outwardly; and a fuel supply module for supplying fuel to the fuel injection module, wherein the fuel injection module serves to generate multistage flames in a burner by forming a rich fuel flame region using the primary fuel injector and forming a lean fuel flame region behind the rich fuel flame region using the secondary fuel injectors through a burning process of gasifying secondary fuel.

In the fuel injection system, the secondary fuel injectors may be disposed around the primary fuel injector such that the secondary fuel injectors are positioned on a circumference in the air supply module at regular intervals.

The number of the secondary fuel injectors may be 6~12.

The fuel injection system may further include a rotary blower module provided at a front end of the primary fuel injector and configured such that air is obliquely supplied with respect to an axial direction of the fuel injection module.

The rotary blower module may include a hollow cylindrical body, and guide blades disposed in the body to be obliquely directed with respect to an axial direction of the body, and the guide blades may serve to guide the air supplied from the air supply module to the rotary blower module to the rich fuel flame region.

Primary air supplied from a central part of the rotary blower module and secondary air supplied through the guide blades may form a multistage air layer in the rich fuel flame region.

The fuel injection system may further include a mounting module which includes a central hollow portion in which the fuel injection module is disposed and is connected one side thereof with the air supply module.

The mounting module may be provided therein with a fuel transport tube such that secondary fuel supplied from the fuel supply module is indirectly heated by primary flame generated in the rich fuel flame region.

The fuel transport tube may be provided along an inner wall of the mounting module in the form of a coil.

The mounting module may be provided therein with a refractory material having high heat resistance.

The fuel may be liquid fuel such as heavy oil or diesel oil.

Another aspect of the present invention provides a burner for burning fossil fuel, a fuel injection module including a primary fuel injector and one or more secondary fuel injectors disposed around the primary fuel injector; an air supply module for supplying air to the fuel injection module inwardly and outwardly; a fuel supply module for supplying fuel to the fuel injection module; a rotary blower module provided at a front end of the primary fuel injector and configured such that air is obliquely supplied with respect to an axial direction of the fuel injection module; and a mounting module which includes a central hollow portion in which the fuel injection module is disposed and is connected one side thereof with the air supply module, wherein the fuel injection module serves to generate multistage flames in a burner by forming a rich fuel flame region using the primary fuel injector and forming a lean fuel flame region behind the rich fuel flame region using the secondary fuel injectors through a burning process of gasifying secondary fuel.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

The above and other objects, features and advantages of the present invention will be more clearly understood from the following detailed description taken in conjunction with the accompanying drawings.

Hereinafter, preferred embodiments of the present invention will be described in detail with reference to the accompanying drawings.

Figure 1:
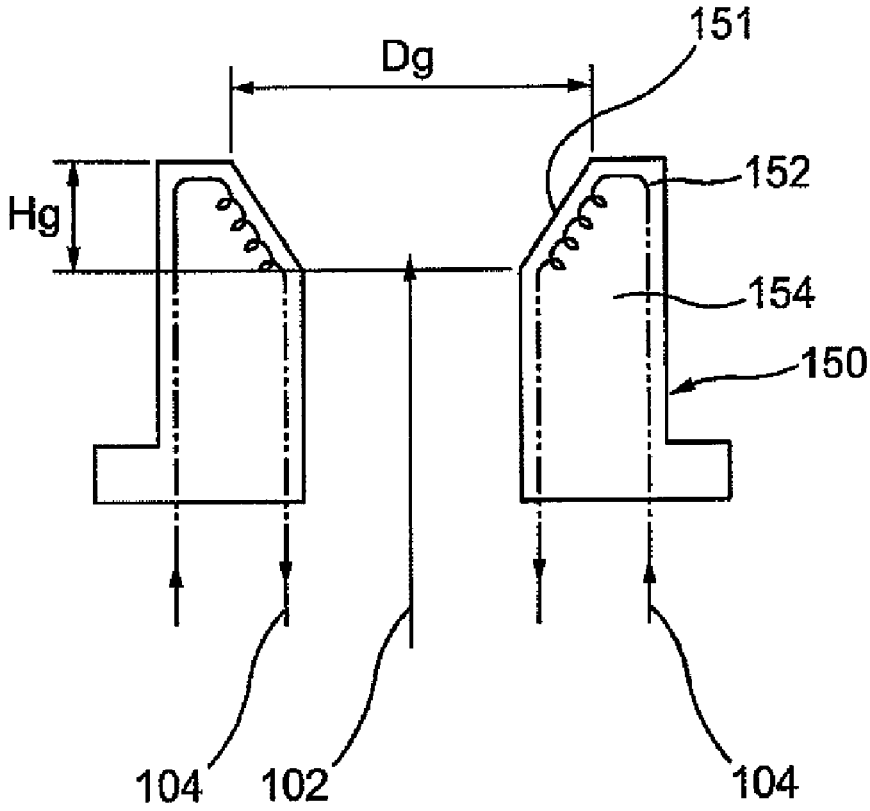
FIG. 1 is a view for explaining a basic principle of a liquid fuel injection system according to an embodiment of the present invention.
Figure 2:
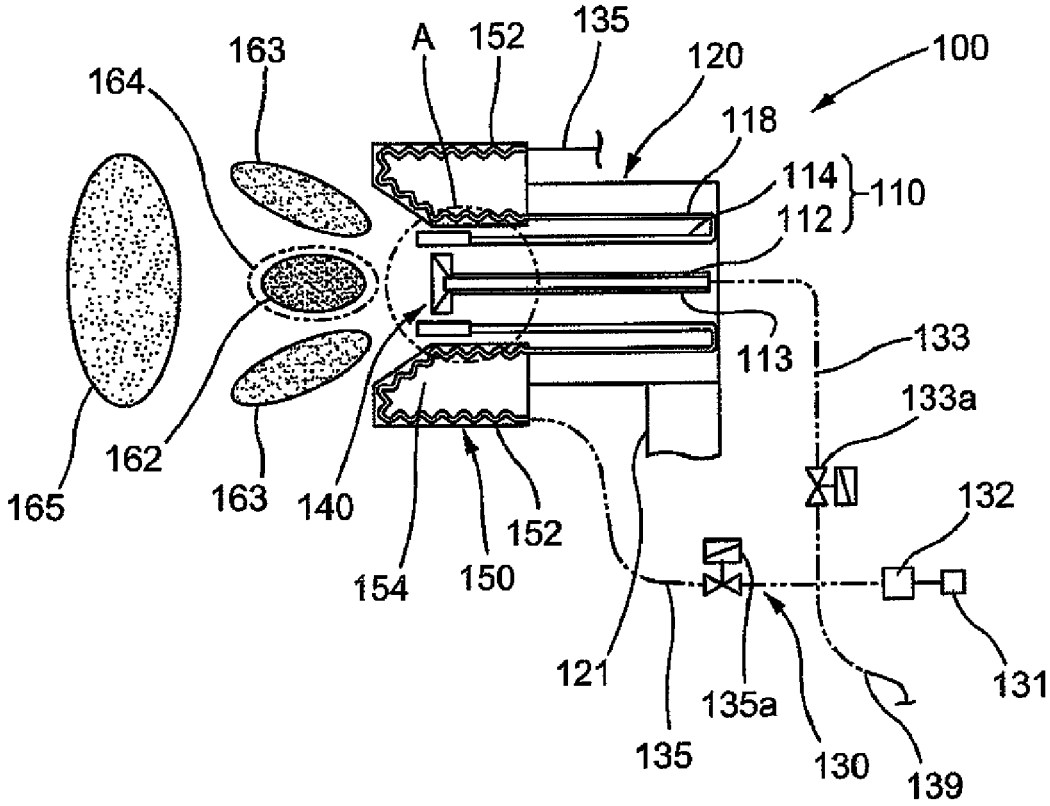
FIG. 2 is a schematic sectional view showing a liquid fuel injection system according to an embodiment of the present invention.
Figure 3:
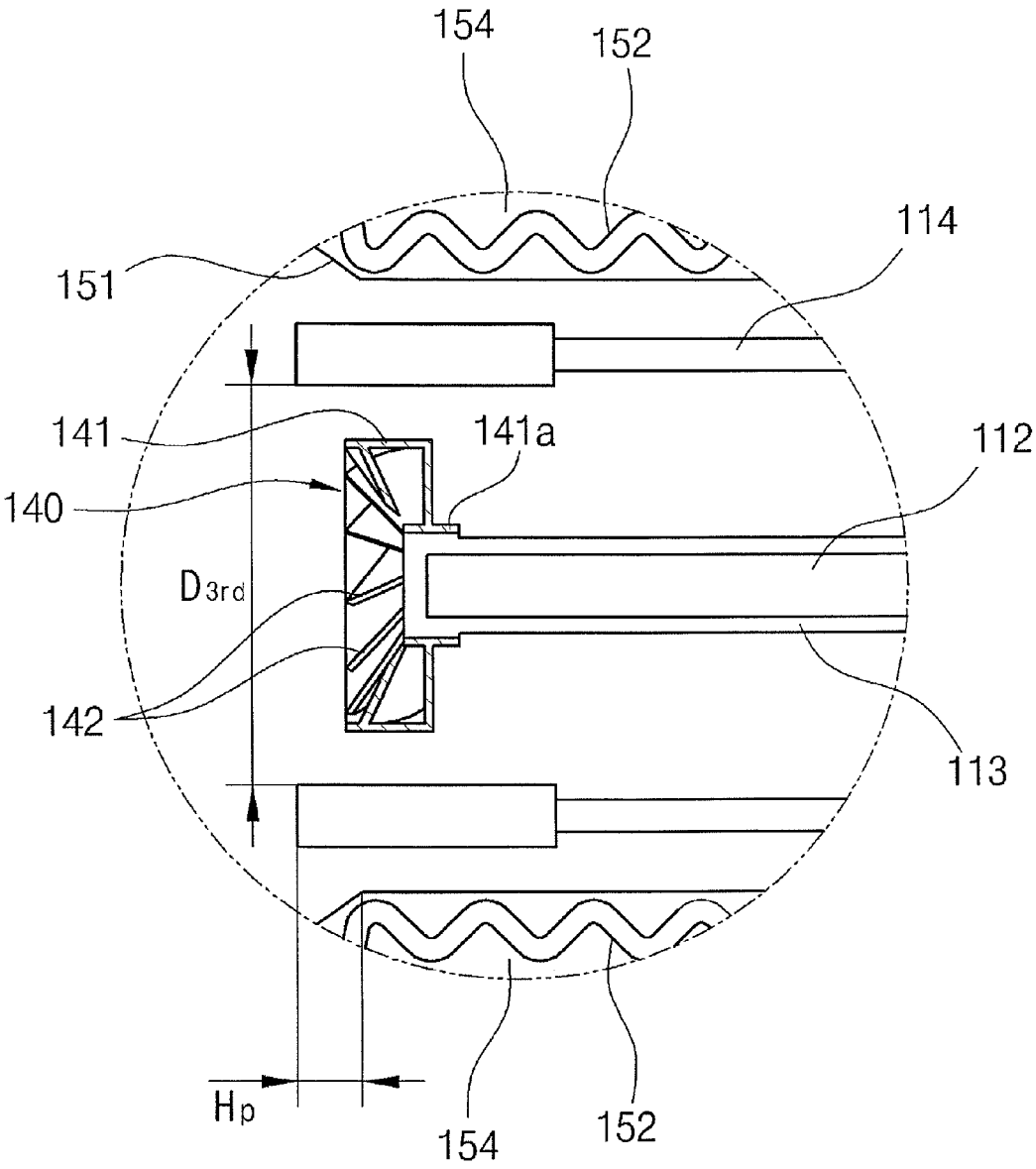
FIG. 3 is a partially enlarged view of 'A' in FIG. 2.
Figure 4:
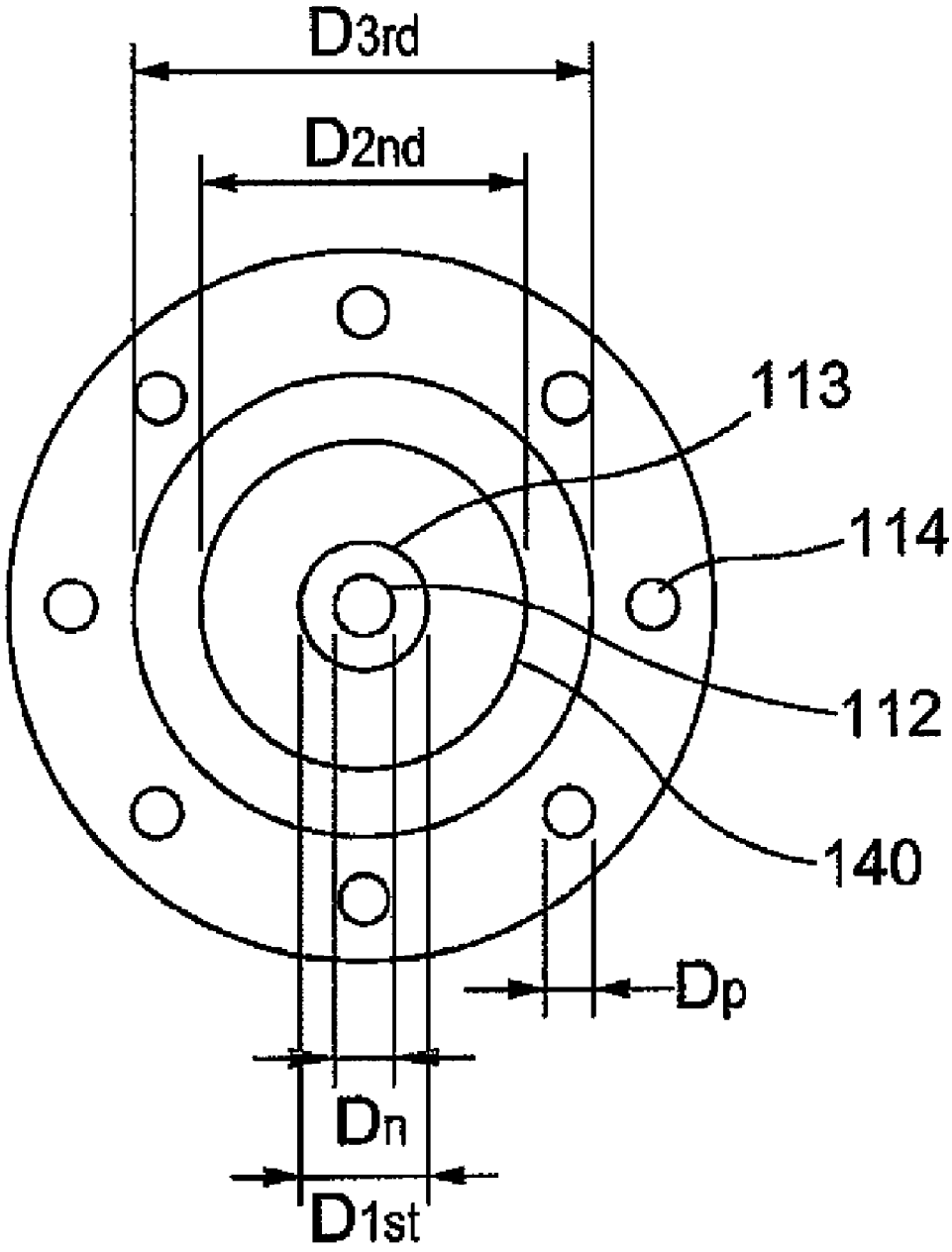
FIG. 4 is a view showing an injection nozzle of a fuel injection system according to an embodiment of the present invention.
Figure 5:
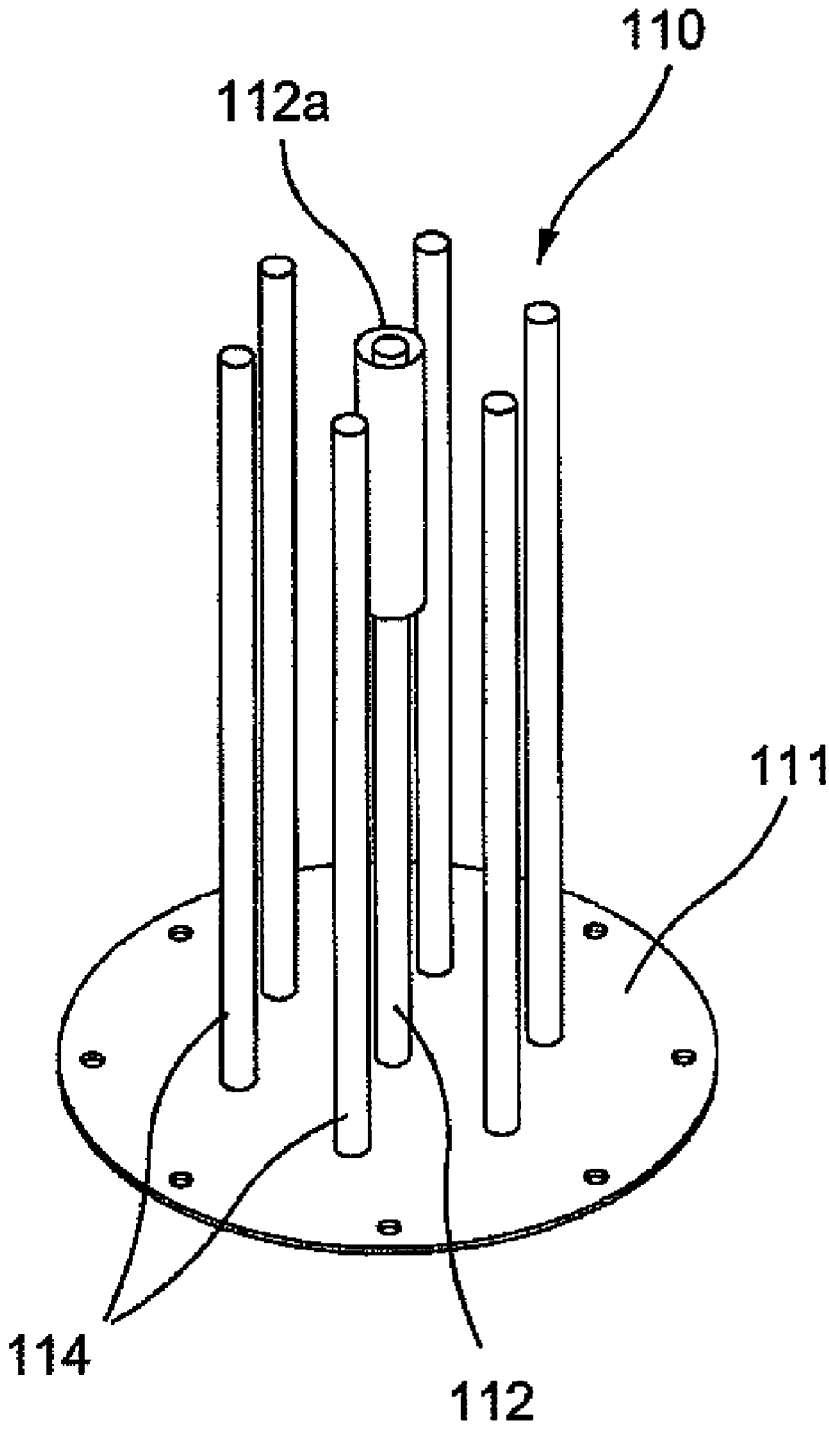
FIG. 5 is a perspective view showing a fuel injection module constituting a fuel injection system according to an embodiment of the present invention.
Figure 6:
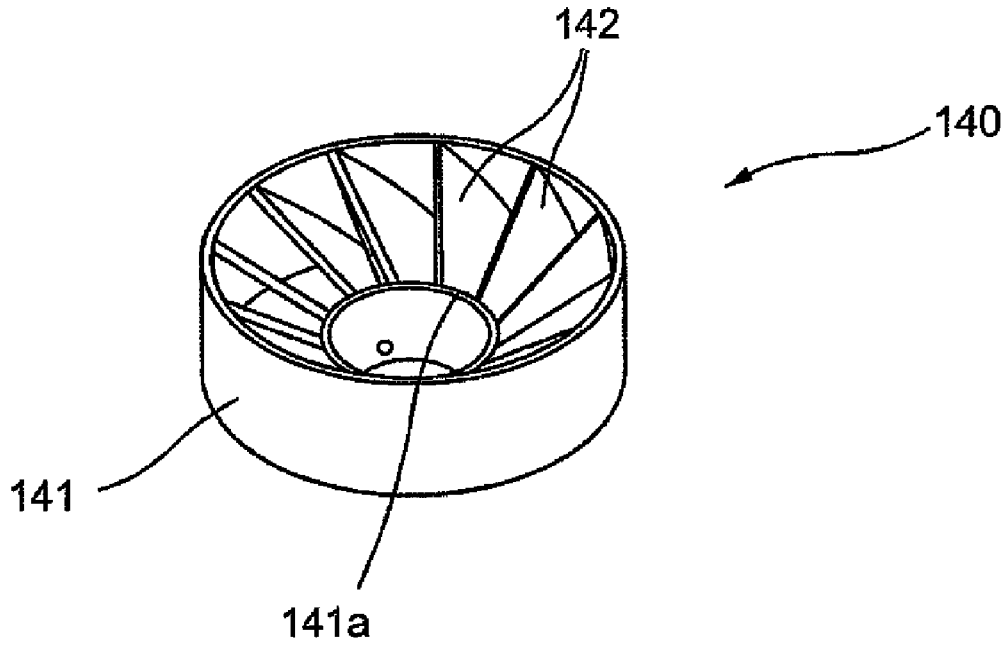
FIG. 6 is a perspective view showing a rotary blower constituting a fuel injection system according to an embodiment of the present invention.
Figure 7:
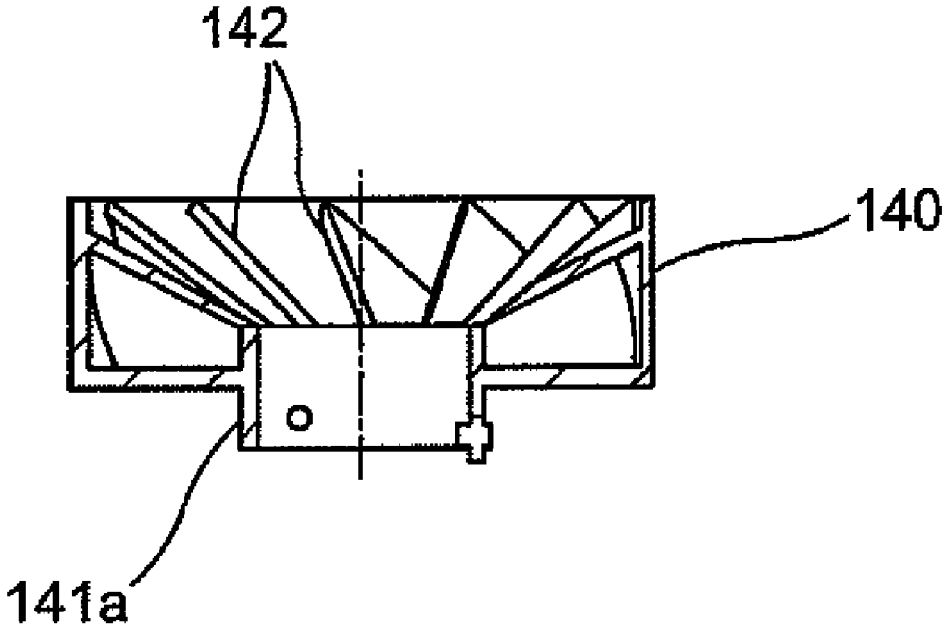
FIG. 7 is a section view showing the rotary blower in FIG. 6.
Figure 8:
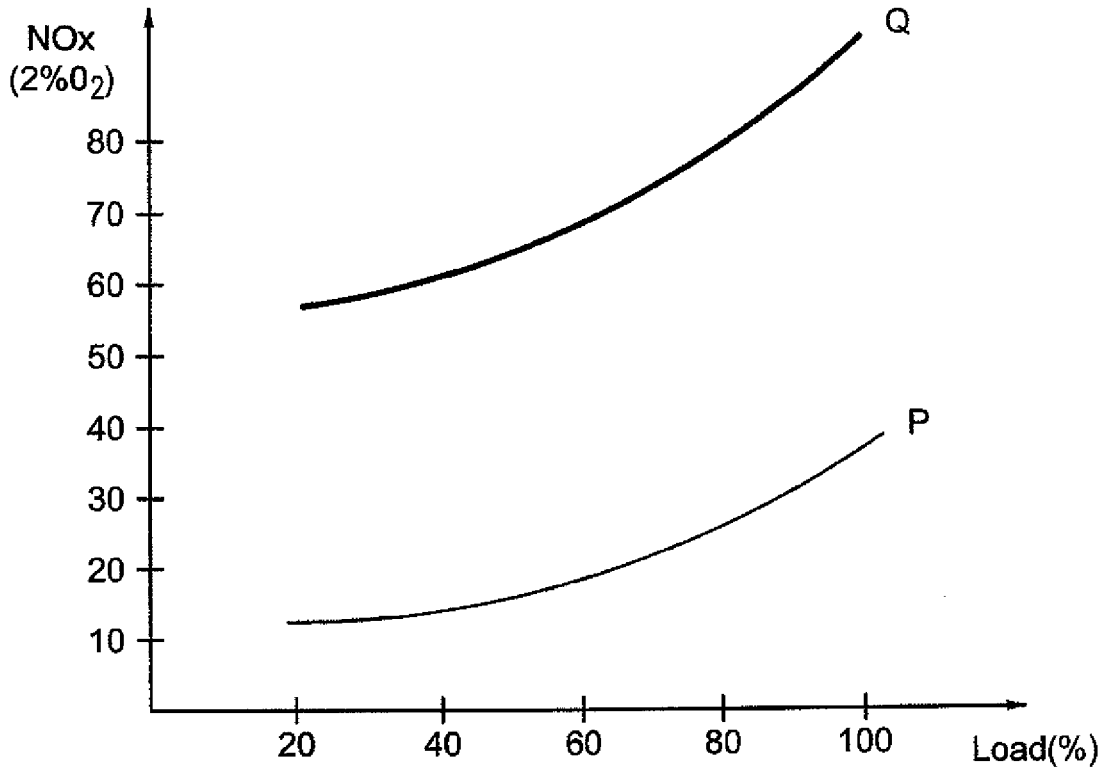
FIG. 8 is a graph showing example of the concentration of harmful gas discharged from the fuel injection system according to an embodiment of the present invention.

FIG. 1 is a view for explaining a basic principle of a liquid fuel injection system according to an embodiment of the present invention; FIG. 2 is a schematic sectional view showing a liquid fuel injection system according to an embodiment of the present invention; FIG. 3 is a partially enlarged view of 'A' in FIG. 2; FIG. 4 is a view showing an injection nozzle of a liquid fuel injection system according to an embodiment of the present invention; FIG. 5 is a perspective view showing a fuel injection module constituting a liquid fuel injection system according to an embodiment of the present invention; FIG. 6 is a perspective view showing a rotary blower constituting a liquid fuel injection system according to an embodiment of the present invention; FIG. 7 is a section view showing the rotary blower in FIG. 6; and FIG. 8 is a graph showing example of the concentration of harmful gas discharged from the liquid fuel injection system according to an embodiment of the present invention.

First, constituents of a liquid fuel injection system 100 according to an embodiment of the present invention are described with reference to FIGS. 1 to 3.

The liquid fuel injection system 100 is a system for injecting liquid fuel into a boiler (not shown) or a burner. Currently, liquid fuel is still commonly used in middle or large size boilers and burners, and technologies for reducing air pollutants are not sufficiently developed yet. Therefore, under these circumstances, in order to remarkably decrease the investment cost for post-treatment facilities, to overcome the technical dependence on advanced countries and to gain an initial advantage in comparatively important technologies, it is required to develop a boiler or burner that is not harmful to the environment and that has ultrahigh thermal efficiency.

As the liquid fuel used in the boiler or burner, heavy oil is chiefly used, but any fuel may be used as long as it is liquid. In addition to the liquid fuel, solid fuel may also be used by changing its structure under the given conditions.

The liquid fuel injection system 100 includes a fuel injection module 110 for supplying and injecting fuel into a burner, an air supply module 120 which is provided therein with the fuel injection module 110 and supplies air or an oxidant to the inside and outside of the fuel injection module 110, a fuel supply module 130 for supplying liquid fuel to the fuel injection module 110, a rotary blower module 140 provided at the injection tip of the fuel injection module 110, and a mounting module 150 for mounting and fixing the fuel injection module 110 and the air supply module 120 thereto.

With reference to FIG. 1, the basic principle of the liquid fuel injection system 100 is explained as follows.

The mounting module 150 has a hollow cylindrical shape. Primary fuel may be supplied through the hollow portion of the mounting module 150, and may be indirectly heated by the passage of secondary fuel through a fuel transport tube 152 buried in a refractory material 154 in the mounting module 150. An arrow 102 indicates that primary fuel is supplied into a burner through the hollow portion of the mounting module 150, and arrows 104 indicate that secondary fuel is supplied into the mounting module 150 through the fuel transport tube 152.

The mounting module 150 has an inner cone-shaped taper surface 151 whose inner diameter is increased toward the burner. The outermost diameter of the inner taper surface 151 is defined as "Dg". The distance between the inner end and outer end of the inner taper surface 151 is defined as "Hg (height of inner taper surface)".

With reference to FIGS. 2, 3, 5 and 6, the fuel injection module 110 is explained in detail as follows.

The fuel injection module 110 includes a support plate 111, a primary fuel injector 112 fixed on the support plate 111, and one or more secondary fuel injectors 114 disposed adjacent to the primary fuel injector 112. The secondary fuel injectors 114 may be disposed on a circumference of the support plate 111 at regular intervals, and, for example, six secondary fuel injectors 114 may be disposed thereon. The primary fuel injector 112 may be provided at one end thereof with an additional flame-resistant cover 112*a*. The primary and secondary fuel injectors 112 and 114 may be fabricated in the form of a hollow cylindrical tube. The primary fuel injector 112 is covered with a primary air supply tube 113, and air having passed through the primary air supply tube 113 may be supplied toward an inner hollow cylinder 141*a* provided in a rotary blower module 140.

An igniter (not shown) may be provided near the primary fuel injector 112. The igniter serves to generate sparks in order to easily burn a mixture of fuel and air. The igniter may receive signals from an additional ignition transistor (not shown).

The primary fuel injector 112 and secondary fuel injectors 114 are supplied with primary liquid fuel and secondary liquid fuel from a fuel supply module 130, respectively. The fuel supply module 130 is connected to the fuel injection module 110 through a first fuel line 133 and a second fuel line 135 diverging from a fuel pump 132 which is intended to pump fuel from which impurities are removed by a filter 131. The first and second fuel lines 133 and 135 are provided with solenoid valves 133*a* and 135*a*, respectively, thus properly supplying and blocking the primary liquid fuel and secondary liquid fuel to the primary fuel injector 112 and secondary fuel injectors 114. An oil drain pipe 139 serves to discharge oil to the outside when excess fuel is supplied from the fuel supply module 130 or an abnormal condition occurs.

Referring to FIGS. 2 and 3, basically, a primary flame is formed by the primary liquid fuel injected from the primary fuel injector 112, and, in order to apply partial oxidation, the secondary liquid fuel injected from the secondary fuel injectors 114 is supplied through a buried fuel tube provided in a mounting module 150.

The mounting module is filled with a refractory material 154. The refractory material may be provided therein with a hollow fuel transport tube 152 in the form of coil.

In order to easily evaporate liquid fuel for a partial oxidation reaction, the fuel transport tube 152 is buried in the refractory material 154 such that the secondary liquid fuel is heated by the primary flame, and the fuel transport tube 152 is fabricated in the form of a coil to increase the residence time of the secondary liquid fuel, thereby maximizing heating efficiency.

In this case, the secondary liquid fuel heated by the mounting module 150 is supplied to a manifold 118 provided in the liquid fuel injection system 100, and is then supplied to six to twelve secondary fuel injectors 114 diverging from the manifold 118. Sine the number of the secondary fuel injectors 114 is not limited, the number thereof may be determined such that users can acquire necessary performances.

The air supply module 120 is provided therein with the fuel injection module 110, and supplies air inflowing from an air inlet provided at one side of the air supply module 120 to a burning chamber.

Next, a partial oxidation process, which is an important factor of the present invention, is explained as follows.

The supplied secondary liquid fuel is preheated before burning while passing through the fuel transport tube 152. The preheated secondary liquid fuel is rapidly injected into a burner through the secondary fuel injectors 114, and is simultaneously atomized around the primary flame. The atomized secondary liquid fuel is reacted with residual oxygen, other than the oxygen in the air discharged from the air supply module 120 and reacted with the primary flame, to cause a partial oxidation reaction. The partial oxidation reaction is represented by Reaction Formula 1 below.

$$C_nH_m+O_2 \rightarrow CO+H_2$$ □Reaction Formula 1□

That is, the atomized secondary liquid fuel (hydrocarbons) is reacted with oxygen to form synthetic gas. The synthetic gas includes $H_2$, CO, $N_2$, $CH_t$, and the like. As described above, since the liquid fuel is converted into flammable gases, nitrogen included in the liquid fuel is not oxidized into NOx, and is converted into molecular nitrogen ($N_2$) and then discharged. The flammable components included in the synthetic gas are formed into flames under lean fuel conditions.

Hereinafter, the relationship between the primary fuel injector 112, the secondary fuel injectors 114 and the rotary blower module 140 is described with reference to FIG. 4 and Mathematical Formulae below.

The marks used in the following Mathematical Formulae are defined as follows.

Dn: diameter of primary fuel injector,

Dp: diameter of secondary fuel injector, $D_{1st}$: diameter of primary air discharge region from which primary air is discharged to the space between primary fuel injector and rotary blower, $D_{2nd}$: outer diameter of rotary blower, and $D_{3rd}$: diameter of secondary air discharge region from which secondary air is discharged to the circumferential space between primary fuel injector and secondary fuel injectors.

In $D_{3rd}$, the unit of "C" may be $(m^2 \cdot s)/J$, and thus the unit of "CQ" is indicated in "m".

The following Mathematical Formulae show the relationship between the above diameters.

$$D_{1st} = A\sqrt{\frac{\pi(D_{3rd}^2 - D_n^2)}{4}}$$ [Mathematical Formula 1]

$$(A{:}0.05 \mid 0.2)$$

$$D_{2nd} = B\sqrt{\frac{\pi(D_{3rd}^2 - D_{1st}^2)}{4}}$$

$$(B{:}0.3 \mid 0.6)$$

$$D_{3rd} = \sqrt{CQ + D_n^2}$$

$$(C{:}0.90 * 10^{-11} \sim 7.31 * 10^{-11}[(m^2 s)/J])$$

$Q$: Heat load ($J$/s)

The following Mathematical Formula 2 may be deduced with reference to FIGS. 1 and 3.

$$\frac{D_q}{D_{3rd}}{:}2.0 \mid 4.0,\ \frac{H_q}{D_{3rd}}{:}0.4 \mid 1.2$$ □Mathematical Formula 2□

Referring to FIG. 3, it can be seen that the height of the secondary fuel injectors 114 with respect to the lowermost end of the inner taper surface 151 of the mounting module 150 is varied. Assuming that the height of the secondary fuel injector 114 protruding from the lowermost end of the inner taper surface 151 of the mounting module 150 is "$H_p$", the relationship between $H_p$ and $D_{3rd}$ may be represented by Mathematical Formula 3 below.

$$0.2 <= \frac{D_{3rd}}{H_p} <= 200$$ □Mathematical Formula 3□

Hereinafter, a rotary blower module 140 is described with reference to FIGS. 6 and 7.

The rotary blower module 140 includes a hollow cylindrical body 141, and guide blades 142 which are obliquely disposed with respect to the axial direction and the radial direction of the body 141. The body 141 is also provided therein with an inner hollow cylinder 141*a* to which the inner ends of the guide blades 142 are connected. The primary fuel injector 112 is connected to the rotary blower module 140 through the inner hollow cylinder 141*a*, and thus the front end of the primary fuel injector 112 may be covered with the rotary blower module 140.

Hereinafter, the operation of the liquid fuel injection system 100 is described in detail with reference to FIGS. 1 to 7. In the liquid fuel injection system 100, a primary space 162 for forming a primary flame is located in front of the primary fuel injector 112 for injecting primary liquid fuel. The primary space 162 is formed in a burning chamber, and is defined as a space placed in front of the fuel injection module 110 and rotary blower module 140.

The air supplied to the primary space 162 is analyzed as follows. First, when air is supplied to the rotary blower module 140 through the air supply module 120, primary air having axial momentum is transferred to the primary flame through the inner hollow cylinder 141*a* provided in the rotary blower module 140, and secondary air having tangential momentum is transferred thereto through the guide blades 142 of the rotary blower module 140. The secondary air serves as an auxiliary flame of the primary flame because it has tangential momentum.

That is, the primary air and a part of the secondary air are supplied to the primary space 162 in multi-stages and then go through a burning process to form a stable flame. The primary space 162 is a main flame forming region in which about 50% or more of fuel is injected and then burned. The primary space 162 is surrounded by a lean fuel space 164. The lean fuel space 164 may be a region in which a part of the secondary air is mixed with a very small amount of fuel.

A secondary space 165 is formed behind the primary space 162. That is, the secondary space 165 is located at a position spaced apart from the primary space toward a burner.

A process of forming a secondary flame in the secondary space 165 is described as follows.

The secondary liquid fuel injected from the secondary fuel injectors 114 passes through the fuel transport tube 152 provided in the mounting module 150. At this time, the temperature of the secondary liquid fuel is increased by heat transferred from the primary flame formed by burning the primary liquid fuel injected from the primary fuel injector 112. Further, the heated secondary liquid fuel is atomized toward the primary space 162, and then partially oxidized by residual oxygen to form a partial oxidation space 163. Through the above process, the secondary liquid fuel injected from the secondary fuel injectors 114 is converted into various flammable gases.

The flammable gases present in the partial oxidation space 163 are mixed with tertiary air supplied toward the outer wall of the rotary blower module 140, and then move downstream of the primary flame to form a lean fuel flame. This lean fuel flame forms the secondary space 165.

Here, tertiary air having axial momentum is supplied to the partial oxidation space 163 through the space between the outer wall of the rotary blower module 140 and the mounting module 150. The tertiary air is mixed with the partially-oxidized fuel gas, and then supplied to the secondary space 165.

The primary liquid fuel injected from the primary fuel injector 112 is formed into the primary space 162, which is a stable rich fuel flame region, by multistage air flow in a burner, and the secondary liquid fuel injected from the secondary fuel injectors 114 is partially oxidized by residual oxygen and heat transmitted from the primary flame formed by the primary fuel injector 112, and thus converted into various flammable gases to form the secondary space 165, which is a lean fuel flame region, downstream of the primary flame. Therefore, the flame is definitely divided into the rich fuel flame region and the lean fuel flame region.

According to the fuel injection system 100, the flame is definitely divided into the rich fuel flame region and lean fuel flame region. Therefore, in the fuel injection system, the formation of local high-temperature regions in the flames is minimized, and thus the formation of thermal NOx can be maximally prevented. Additionally, about 50% or less of the total amount of fuel is converted into flammable gases, so that most of nitrogen in the fuel is not oxidized into NOx and is discharged in the form of molecular nitrogen ($N_2$), and the NOx included in the primary flame is reduced to molecular nitrogen ($N_2$) under the condition of rich fuel flame and then discharged, with the result that the formation of fuel NOx attributable to the oxidation of nitrogen components present in fuel can also be basically prevented.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A fuel injection system, comprising:

a fuel injection module including a fuel injection tip, a primary fuel injector and one or more secondary fuel injectors disposed around the primary fuel injector;

a rotary blower module provided at the injection tip of the fuel injection module, and including a hollow cylindrical body and guide blades disposed in the body, wherein the guide blades are obliquely directed with respect to an axial direction of the body;

an air supply module which supplies air to the fuel injection module; and a fuel supply module which supplies fuel to the fuel injection module, wherein the rotary blower module is affixed to a free end of the primary fuel injector, and the guide blades of the rotary blower module encompass the free end of the primary fuel injector, wherein Dn is a diameter of the primary fuel injector, Dp is a diameter of the one or more secondary fuel injectors, $$D_{1st}\left(D_{1st} = A\sqrt{\frac{\pi(D_{3rd}^2 - D_n^2)}{4}} \quad (A{:}0.05|0.2)\right)$$

is a diameter of a primary air discharge region from which primary air is discharged to a space between the primary fuel injector and the rotary blower module, $D_{2nd}$ $$D_{2nd}\left(D_{2nd} = B\sqrt{\frac{\pi(D_{3rd}^2 - D_{1st}^2)}{4}} \quad (B{:}0.3|0.6)\right)$$

is an outer diameter of the rotary blower module, $$D_{3rd}D_{3rd} = \sqrt{CQ + D_n^2} \quad (C{:}0.90*10^{-11} \sim 7.31*10^{-11}[(m^2s)/J])\Big)$$

is a diameter of a secondary air discharge region from which primary air is discharged to a circumferential space between the primary fuel injector and the at least one of the one or more secondary fuel injectors, and Q (J/s) is a heat load, wherein the rotary blower module is configured such that air is obliquely supplied with respect to an axial direction of the fuel injection module, and wherein the fuel injection module serves to generate multistage flames in a burner by forming a rich fuel flame region using the primary fuel injector and forming a lean fuel flame region behind the rich fuel flame region using the secondary fuel injectors through a burning process of gasifying secondary fuel.

2. The fuel injection system according to claim 1, wherein the secondary fuel injectors are disposed around the primary fuel injector such that the secondary fuel injectors are positioned on a circumference in the air supply module at equally spaced intervals.

3. The fuel injection system according to claim 2, wherein the number of the secondary fuel injectors is in a range from 6 to 12.

4. The fuel injection system according to claim 1, further comprising:

a mounting module which includes a central hollow portion in which the fuel injection module is disposed and is connected one side thereof with the air supply module.

5. The fuel injection system according to claim 4, wherein the mounting module has an inner taper surface whose inner diameter is increased toward the burner, and, assuming that a diameter of an outer outlet of the inner taper surface is defined as "Dg", and a distance between the inner end and outer end of the inner taper surface is defined as "Hg", the relationship between Dg, Hg and $D_{3rd}$ is represented by the following Mathematical Formula $$\frac{D_g}{D_{3rd}}:2.0\,|\,4.0,\ \frac{H_g}{D_{3rd}}:0.4\,|\,1.2.$$

6. The fuel injection system according to claim 5, wherein the mounting module is provided therein with a fuel transport tube such that secondary fuel supplied from the fuel supply module is indirectly heated by primary flame generated in the rich fuel flame region.

7. The fuel injection system according to claim 6, wherein, assuming that a height of the secondary fuel injector protruding from the inner end of the inner taper surface of the mounting module is defined as "$H_p$", the relationship between $H_p$ and $D_{3rd}$ is represented by the following Mathematical Formula $$0.2 <= \frac{D_{3rd}}{H_p} <= 200.$$

8. The fuel injection system according to claim 7, wherein the fuel transport tube is provided along an inner wall of the mounting module in the form of a coil.

9. The fuel injection system according to claim 4, wherein the mounting module is provided therein with a refractory material having high heat resistance.

10. The fuel injection system according to claim 1, wherein the fuel is liquid fuel such as diesel oil.

11. The fuel injection system according to claim 1, wherein the secondary fuel injectors are variably disposed with respect to the primary fuel injector such that the secondary fuel injectors protrude or retract from the burner.

* * * * *